US005245733A

United States Patent [19]

Goria

[11] Patent Number: 5,245,733

[45] Date of Patent: Sep. 21, 1993

[54] COMBINATION BURIAL VAULT/CASKET

[76] Inventor: Pierre A. Goria, P.O. Box 227, Mcleansville, N.C. 27301

[21] Appl. No.: 843,594

[22] Filed: Feb. 28, 1992

[51] Int. Cl.[5] ..... A61G 17/00

[52] U.S. Cl. ..... 27/35; 264/256

[58] Field of Search ..... 27/2, 6, 7, 4, 35, 19; 264/256

[56] References Cited

U.S. PATENT DOCUMENTS

| | | | |
|---|---|---|---|
| 2,655,714 | 10/1953 | Rench | 27/35 |
| 2,940,156 | 6/1960 | Cook | 27/35 |
| 3,038,232 | 6/1962 | Wean | 27/35 |
| 4,261,083 | 4/1981 | Damby et al. | 27/35 |

*Primary Examiner*—Richard E. Chilcot, Jr.
*Attorney, Agent, or Firm*—Charles Y. Lackey

[57] ABSTRACT

A burial container having a base with a bottom, side walls and end walls and a lid sealably securable to the base. The lid, bottom and walls have inner and outer covers forming hollow chambers capable of being filled with granular substances and liquids for added stability, rigidity and strength. The inner and outer covers are joined at a plurality of locations to hold the covers in a fixed relationship each with the other and strengthen the walls, bottom and lid to withstand the forces exerted by the surrounding earth and water. Various configurations of junctions provide the stability, rigidity and strength needed in the base and lid container.

10 Claims, 4 Drawing Sheets

COMBINATION BURIAL VAULT/CASKET

BACKGROUND OF THE INVENTION

1. Field of the Invention

The present invention relates generally to burial containers for the interment of human or animal remains and is particulary concerned with a burial container, the lid and base of which are formed by walls having seamless double covers of resinous materials which are spaced and braced from each other.

2. Description of the Prior Art

Caskets in common use at the present time are generally bulky structures made of wood or metal and fitted with elaborate ornamentation. For the most part, such burial caskets are not completely sealable or cannot withstand the soil loads of interment. Consequently, they are usually placed in a massive burial vault made of concrete or some other suitable material.

Concrete burial vaults are porous and therefore under soil load pressure will eventually permit the flow of moisture into the vault interior. Attempts have been made to line such vaults with plastic or fiberglass shells, however, the continuous pressure of soil load eventually will cause moisture to move through the pores of the concrete and separate the interior shell from the concrete to which it was originally adhered. An example of the plastic lined version of such a vault is shown in U.S. Pat. No. 3,439,461.

Other coatings have been applied to the concrete walls of vaults in an attempt to completely seal them from moisture. In none of these earlier developments has 100% efficiency in preventing moisture seepage and wall separation been achieved. Other variations in vault construction include forming a double wall of reinforced concrete having an inner asphalt liner between the two concrete walls. Other vaults have been made of various molded plastic resinous materials, concrete outer walls having inner liners of glass fiber reinforced resin, and various other materials.

All such prior vaults have had certain desirable advantages, and, in some instances, certain undesirable features and disadvantages. For example, burial vaults made entirely of reinforced concrete, when properly made and of proper wall thickness, have adequate structural and tensil strength to resist the crushing force of the overlying earth load as well as the additional pressure of earth handling machinery moved thereover commonly occurring in cemetary operations. However, such vaults made of reinforced concrete are heavy and tend to allow moisture to infiltrate through the porous concrete wall of the vault due to the hydrostatic pressure in the grave opening.

Prior burial vaults made entirely of synthetic plastic resinous materials have been known and used heretofore and certain of them have desirable advantages and characteristics. Yet a distinct disadvantage is the lack of adequate structural, tensil and flexural strength and the resulting inability to withstand the crushing weight of the overlying earth load and the hydrostatic pressure when the vault is interred in the grave opening, and the inability to withstand the additional weight of earth handling machinery moving thereover.

SUMMARY OF THE INVENTION

Accordingly, an object of the present invention is to provide a new and improved composite hollow walled burial container where the outside wall cover is tied to the inside wall cover and the lid is secured to the base by chemical and/or mechanical means.

A further object of the present invention is to provide a burial container wherein the lid and base are formed from synthetic resinous material of one piece and seamless construction.

Another object of the present invention is to form the hollow-wall base and lid units of the present invention by securing the outer wall cover to the inner wall cover to secure the walls against displacement relative to one another and which act in compression or tension rather than in mere resistance to flexing.

Yet another object of the present invention is to provide a burial container which may be produced by simple rotational molding and filling techniques and which does not require a special heavy-duty mold, an adhesive bonding agent, special climate controls, and precise manufacturing procedures.

Yet still another further object of the present invention is to provide a new and improved hollow-wall burial container, the lid and base units of which are light in weight, can be readily handled and transported economically over substantial distances, and can be filled at the gravesite with regular concrete or at remote locations with a pumpable light-weight cellular concrete in a preselected density range for additional strength.

These and other objects and advantages of the present invention will become more apparent after consideration of the following detailed description and accompanying drawings wherein like characters of reference designate like parts throughout the several views.

BRIEF DESCRIPTION OF THE DRAWINGS

The invention will be better understood and objects other than those set forth above will become apparent when consideration is given to the following detailed description. Such description makes reference to the annexed drawings where.

DESCRIPTION OF THE PREFERRED EMBODIMENT

Figure 1:
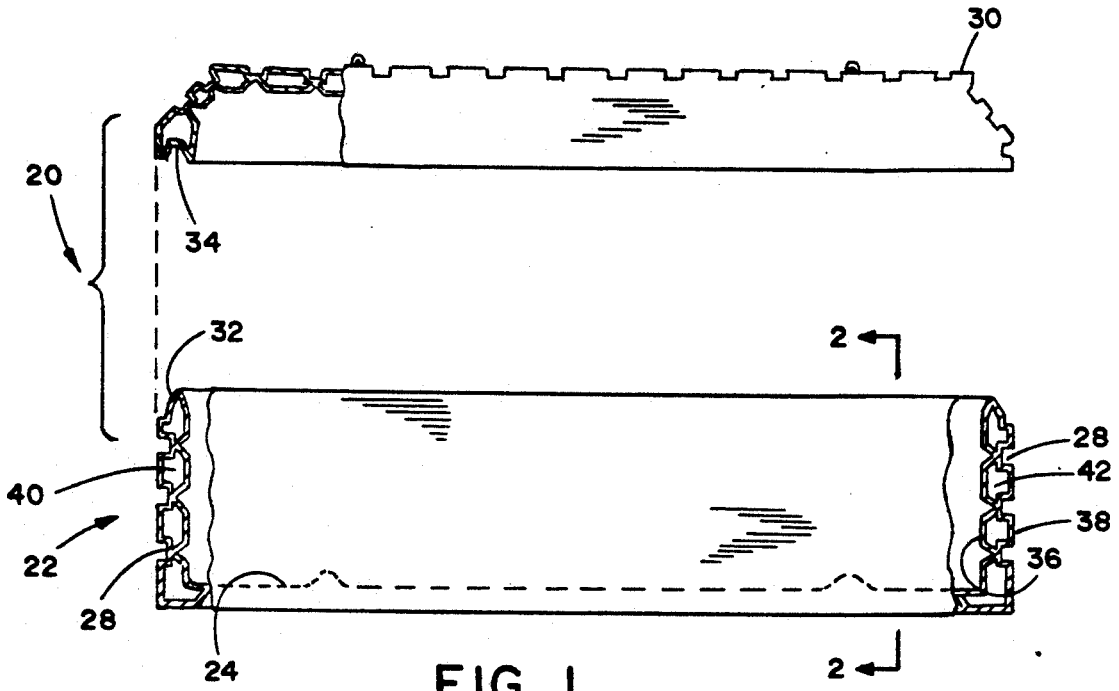
FIG. 1 is a side elevational, sectional, and exploded view of a burial container embodying a construction of the present inventive concept.
Figure 2:
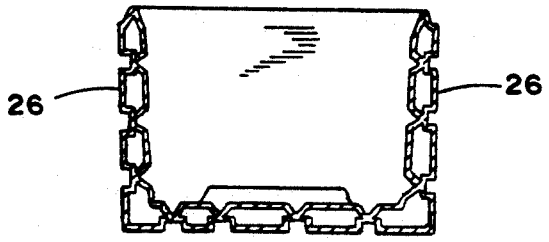
FIG. 2 is an end elevational and sectional view of the base of the burial container shown in FIG. 1.
Figure 3:
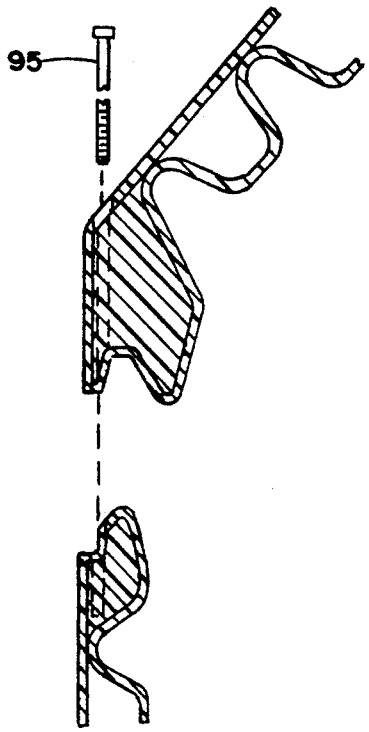
FIG. 3 is a sectional, enlarged, exploded, and fragmentary view of another form of construction embodying the present inventive concept and illustrating the use of bolts to fasten the lid to the base.
Figure 4:
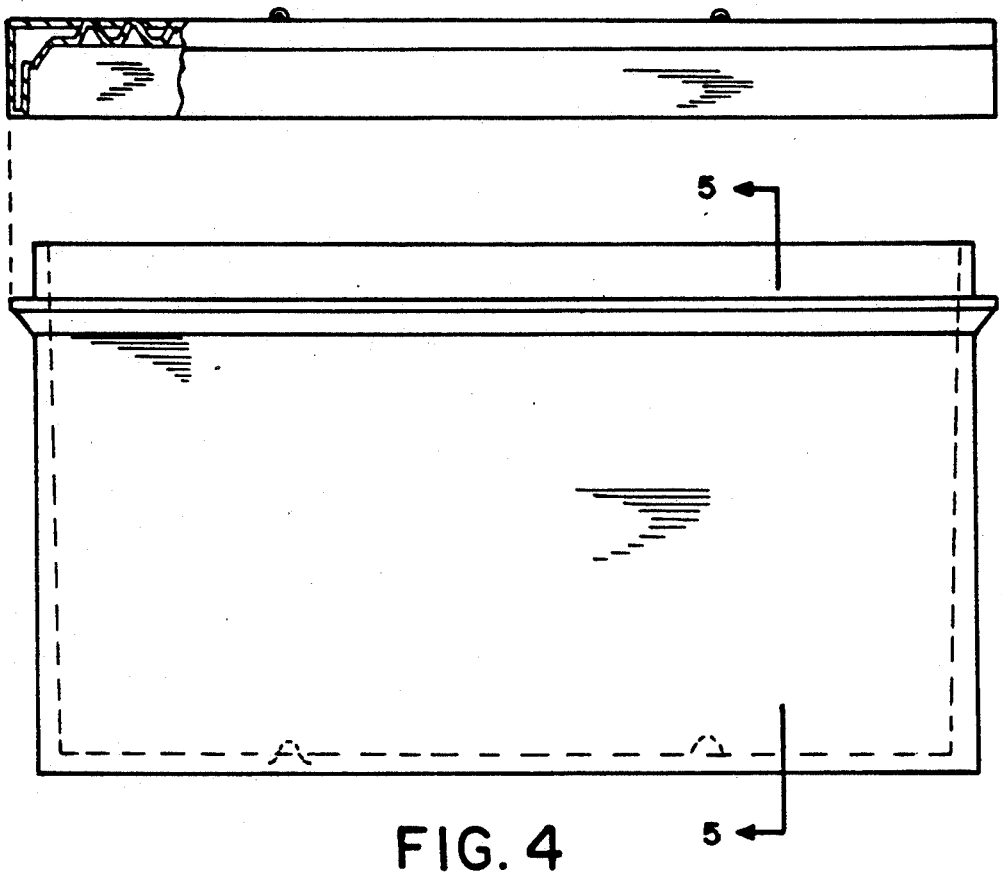
FIG. 4 is a side elevational, section, and exploded view of a double depth burial container having a different wall-connecting construction.
Figure 5:
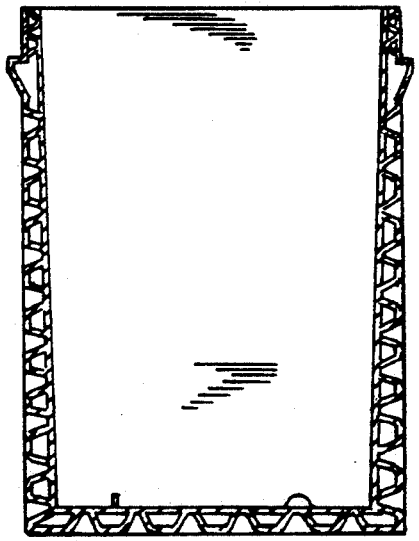
FIG. 5 is an end elevational and sectional view of the base of FIG. 4.

Referring now to the drawings and particularly to FIG. 1, a burial container shown generally as 20 has a base generally shown as 22 which is provided with a bottom 24, side walls 26, end walls 28 and a lid 30. Lid 30 is sealably securable to base 22 by the innterlocking action of a formed extension 32 within recess 34 of lid 30. The burial container 20 can be provided with a chemical sealant or other physically acceptable sealing alternatives at the junction of extension 32 and recess 34 that are well known in the art. Lid 30, base 22 and its components bottom 24, side walls 26 and end walls 28 are formed from inner and outer covers 36, 38 which, because they are essentially hollow, carry a plurality of hollow chambers capable of being filled with a number of substances including regular concrete, cellular concrete, sand, granular mixed and/or liquid solutions. Inner and outer covers 36, 38 are held in a fixed relationship each with the other at junctions shown generally as 40, 42. These junctions substantially strengthen the walls, lid and bottom of the container to permit them to withstand the forces exerted by surrounding earth and water. That strength can be even more significantly increased by filling the hollow chambers formed by covers 36, 38 with a relatively heavy and dense substance.

Figure 11:
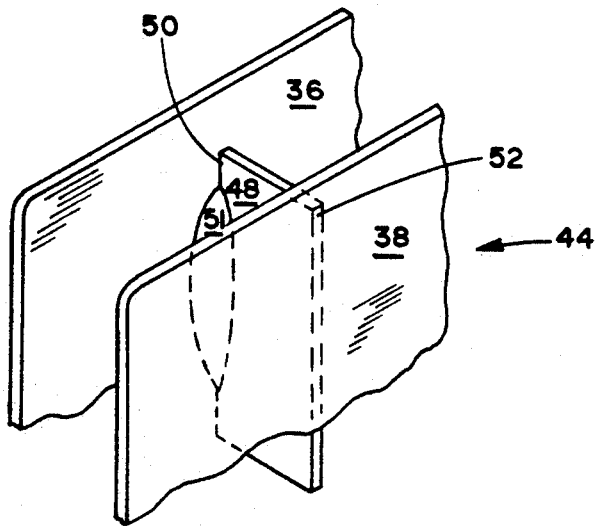
FIG. 11 is a perspective, enlarged, sectional, and fragmentary view of one embodiment of an insert used in the present inventive concept.
Figure 12:
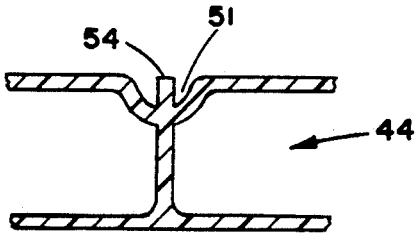
FIG. 12 is a plan and fragmentary view of the insert shown in FIG. 11.

The most straightforward junction is that designated generally as 44 in FIGS. 11 and 12. The substantially flat section 48 has inner and outer cover edges 50, 52 which either prior to or during the molding process are fused to inner and outer covers 36, 38. The more flat sections 48 that are applied, the greater the strength of the resulting burial container. Even greater strength occurs when one or perhaps both of the covers 36, 38 are provided with a recess 51 within which extends the flat section 48 so that a projection 54 is formed on the cover as shown in FIG. 12.

Figure 13:
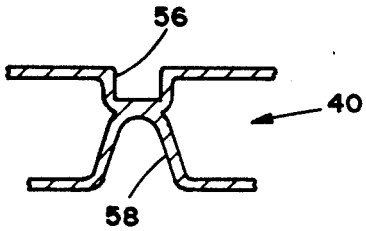
FIG. 13 is a plan view of another embodiment of an insert utilizing the present inventive concept.
Figure 14:
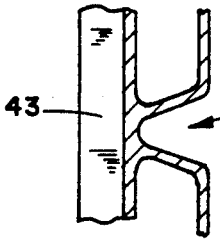
FIG. 14 is a plan and fragmentary view of yet still another form of an insert embodying the present inventive concept.

Junction construction takes many forms, all of which are designed to enhance the physical characteristics of the burial container, particularly by strengthening the covers and resulting walls, bottom and lid. FIG. 13 shows the use of two connecting junctions, the first 56 having a U-shaped configuration and the second 58 being V-shaped.

The junction designated generally as 42 is a V-shaped insert bonded to a series of spaced apart ribs 43 fused to the ouside of either the inner or outer section.

Figure 15:
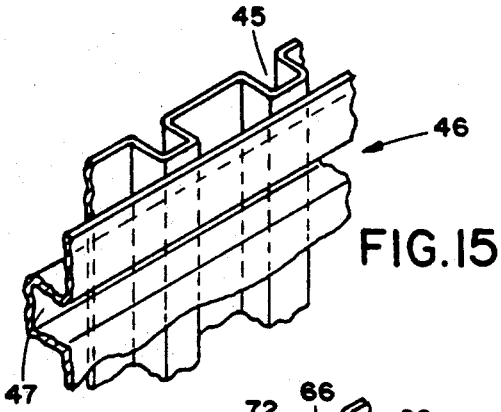
FIG. 15 is a perspective, sectional, and fragmentary view of another embodiment of insert construction utilized in the present inventive concept.
Figure 16:
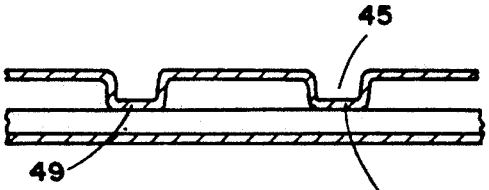
FIG. 16 is a plan, sectional, and fragmentary view of the insert construction of FIG. 15.

FIGS. 15 and 16 illustrate yet another variation of a junction construction developed by forming vertical grooves 45 in one cover and horizontal grooves 47 in the other cover that are fused each with the other at the intersections 49 of the horizontal and vertical grooves. This will provide an extremely strong structure for the container's lid, walls and bottom and will eliminate, in many cases, the need for any additional fill or structure reinforcement.

Figure 17:
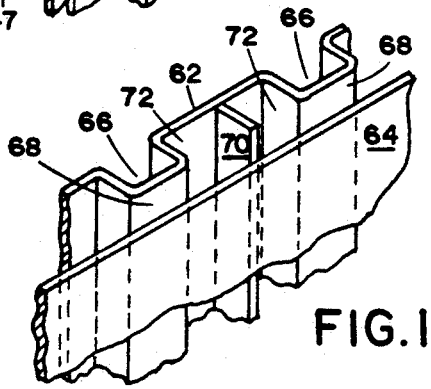
FIG. 17 is a perspective, sectional and fragmentary view of yet another form of insert construction utilizing the present inventive concept.

Yet another variation of a quite acceptable junction structure is shown in FIG. 17 wherein inner cover 62 is connected to outer cover 64 by a series of formed grooves 66, the bottom 68 of which are bonded to the inner wall of cover 64. An additional flat section insert 70 is in position between covers 62, 64 and between grooves 66 in the manner shown. This construction provides additional strength by the addition of flat section 70 and yet still makes available a plurality of hollow chambers 72 that can be filled with additional granular, liquid, or combination substances to provide rigidity and strength.

Figure 7:
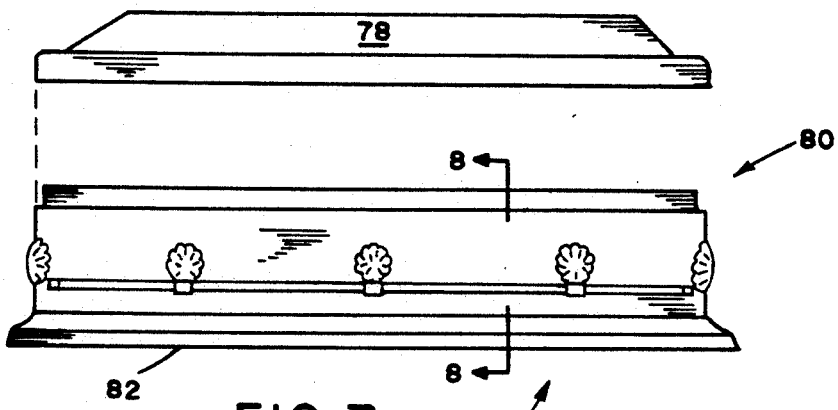
FIG. 7 is a side elevational and exploded view of another burial container construction utilizable with the present inventive concept.
Figure 8:
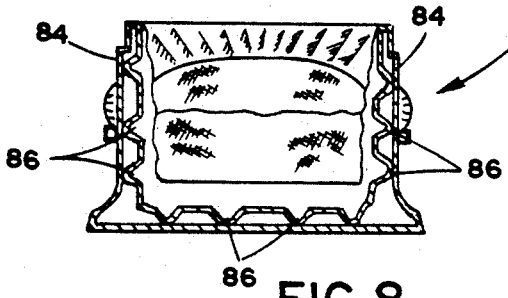
FIG. 8 is an end elevational and sectional view of the base of the burial container shown in FIG. 7.

The container comprising the present invention can be utilized as a vault to serve as an outer container for a insert casket or as a complete burial container in and of itself. For example, FIGS. 7 and 8 illustrate the use of the structure of the present inventive concept in the formation of an aesthetically assembled casket generally shown as 76. Casket 76 has a sealably securable lid 78, a base 80 with a bottom 82, side walls 84 and end walls (not shown in detail). The lid, bottom, and sides all are formed from parallel covers suitably maintained in a spaced relationship and strength-giving configuration by a plurality of junctions 86 as shown in FIG. 8. Such a casket construction can be economically provided, aesthetically designed and decorated, and sealably closed to function in an extremely effective manner, far more effectively than conventional vault and casket combinations.

The burial container of the present invention is preferably formed by rotational molding, a process effectively utilizing special machinery to accomplish a great variety of structural configurations formed from resinous substances. Rotational molding is utilized in a number of industries for making reinforced plastic articles, however the process has not been applied to the burial container industry until now. There are certain modifications in the process to provide the present invention, including the use of flat plastic sections like that designated 48, which can either be preset separately in the mold before the molding operation or formed during the molding operation as a part of the entire structure. In either case, the resulting junction bonds the parallel covers and serves effectively to enhance the strength and rigidity of the walls formed by the joined covers.

Figure 6:
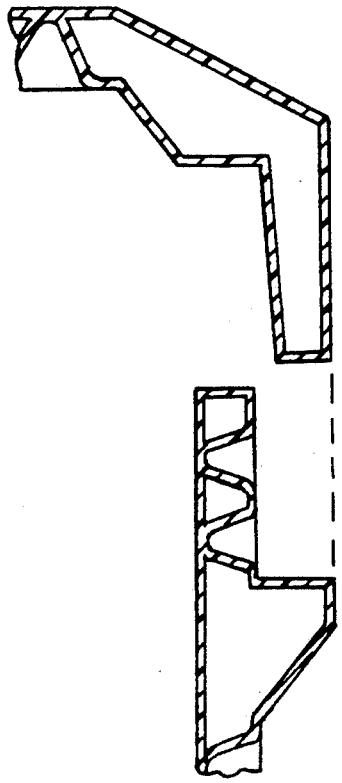
FIG. 6 is a sectional, enlarged, exploded, and fragmentary view of the burial container construction shown in FIGS. 4 and 5.
Figure 9:
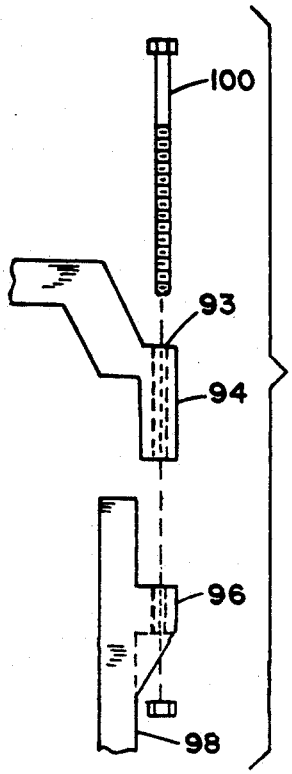
FIG. 9 is a sectional, enlarged, exploded, and fragmentary view of a lid securing mechanicism embodied in a construction of the present invention.

Special sealing applications may be needed to insure a totally waterproof container not susceptible to moisture seepage or other encroachments. FIG. 6 shows an overlapping lid lip 90 snugly engaging a side wall projection 92. A suitable adhesive or binder can be applied between the engaging surfaces of lip 90 and projection 92 to insure a total seal. FIG. 9 shows a slight modification of this configuration by having a plurality of appertures extending through the lip 94 and the ridge 96 of base 98 through which can then be positioned a securing bolt or other suitable element 100. Again, a sealant or other bonding substance can be applied to the contiguous edges of lid 94 and base 96. FIG. 9 shows the use of a plurality of bolts 95 to secure the lid to the base. When this version is used, the bolts 95 should be spaced about 12 inches apart.

Figure 10:
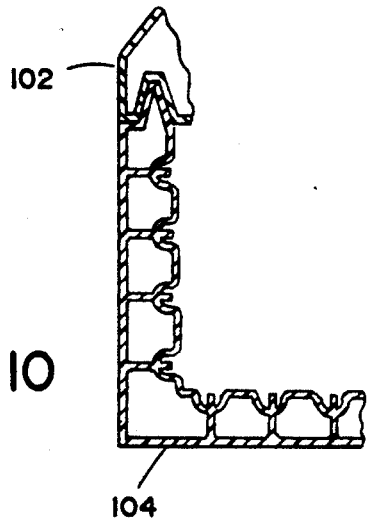
FIG. 10 is a side elevational, sectional, and fragmentary view of another insert configuration in a burial container embodying the present inventive concept.

FIG. 10 shows yet another variation in a complimentary mating of a lid 100 and a base 104 with the insert structure utilizing the configuration illustrated in FIG. 11.

In the event a bolt or other fastening element is used to secure the lid to the base in any of the present embodiments, it is preferably to have the area surrounding the bolt or element formed of solid plastic and not configure it with the junction structures described above. Solid resinous material or plastic will provide a much stronger foundation for the fastening element.

Thus it can be seen that the undesirable characteristics and disadvantages of prior art burial containers have been overcome in the present inventive concept. With respect to the description provided, it is to be realised that the optimum dimensional relationship for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed herein.

The foregoing is therefore considered as illustrative only of the principles of the invention. Further, since numerous modifications and changes will readily occur to those skilled in the art, it is not desired to limit the invention to the exact construction and operation shown and described. All suitable modifications and equivalents that fall within the scope of the appended claims are deemed within the present inventive concept.

What is claimed as being new and what is desired to be protected by Letters Patent of the United States is as follows:

1. A non-corrosive burial container comprising: a seamless single piece base having a bottom, side walls and end walls; a seamless single piece lid sealably securable to the base; and means releasably securing the lid to the base, the lid, bottom, and the side and end walls having inner and outer covers forming hollow chambers capable of being filled with non-adhering granular and cellular substances and liquids, the inner and outer covers connected at a plurality of locations to hold the covers in a substantially fixed relationship with each other and strengthen the lid, bottom, and side and end walls to withstand the forces exerted by the surrounding earth and water.

2. The container as claimed in claim 1 wherein the base and lid have sealable openings to receive non-adhering granular and cellular substances.

3. The container as claimed in claim 1 wherein one of the covers has a plurality of recesses fused to the other cover.

4. The container as claimed in claim 2 wherein one of the covers has a plurality of recesses fused to the other cover.

5. The container as claimed in claim 1 wherein each cover has a plurality of recesses fused to the other cover.

6. The container as claimed in claim 2 wherein each cover has a plurality of recesses fused to the other cover.

7. The container as claimed in claim 1 wherein the covers are connected by forming vertical grooves in one cover and horizontal grooves in the other cover that are fused with each other at the intersections of the horizontal and vertical grooves.

8. The container as claimed in claim 2 wherein the covers are connected by forming vertical grooves in one cover and horizontal grooves in the other cover that are fused with each other at the intersections of the horizontal and vertical grooves.

9. The container as claimed in claim 1 wherein each cover has a plurality of recesses connecting with the recesses of the other cover.

10. The container as claimed in claim 2 wherein each cover has a plurality of recesses connecting with the recesses of the other cover.

* * * * *